US005238151A

United States Patent [19]

Weinstein

[11] Patent Number: 5,238,151

[45] Date of Patent: Aug. 24, 1993

[54] PUSH UP CODISPENSING CONTAINER

[76] Inventor: Jack Weinstein, 5 Blackthorn Pl., Lakehurst, N.J. 08733

[21] Appl. No.: 885,039

[22] Filed: May 15, 1992

[51] Int. Cl.[5] ..... B67D 5/00

[52] U.S. Cl. ..... 222/132; 222/138; 222/330; 222/386

[58] Field of Search ..... 222/129, 132, 135, 136, 222/138, 330, 386

[56] References Cited

U.S. PATENT DOCUMENTS

| | | | |
|---|---|---|---|
| 3,296,803 | 1/1967 | Kroekel | 60/259 |
| 4,205,766 | 6/1980 | White | 222/135 |
| 4,432,469 | 2/1984 | Eble et al. | 222/134 |
| 4,526,295 | 7/1985 | Morel et al. | 222/82 |
| 4,566,610 | 1/1986 | Herb | 222/327 X |
| 4,989,758 | 2/1991 | Keller | 222/137 |
| 5,020,694 | 6/1991 | Pettengill | 222/137 |
| 5,080,262 | 1/1992 | Herold et al. | 222/135 |
| 5,082,147 | 1/1992 | Jacobs | 222/391 X |
| 5,111,972 | 5/1992 | Sakurai et al. | 222/135 |

*Primary Examiner*—Andres Kashnikow

*Assistant Examiner*—J. A. Kaufman

*Attorney, Agent, or Firm*—Kenneth P. Glynn

[57] ABSTRACT

The present invention is a container for codispensing two or more semi-solid products which is operable by outside manual motion. It includes a main body which is divided into at least two compartments by a divider wall so as to form a plurality of compartments with at least a first compartment and a second compartment. It also has an outlet connected to each of the plurality of compartments. There are one or more fins located within the first compartment, this first fin having an inner edge, and being rotatably connected to the housing at the inner edge, and a second fin located in the second compartment, this second fin having an inner edge, and being rotatably connected to the housing at the inner edge. There is a component for simultaneously rotatably moving the plurality of fins so as to decrease the volume within the compartments and so as to push material therein out simultaneously for codispensing. In preferred embodiments, two fins are symmetrical and opposite one another and rotate towards one another to dispense through a common outlet.

9 Claims, 2 Drawing Sheets

FIG. 1
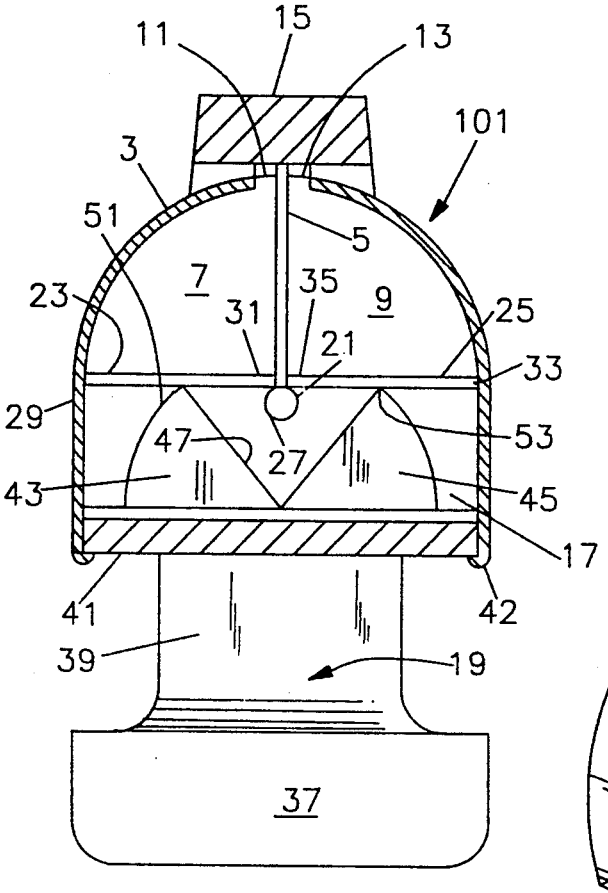
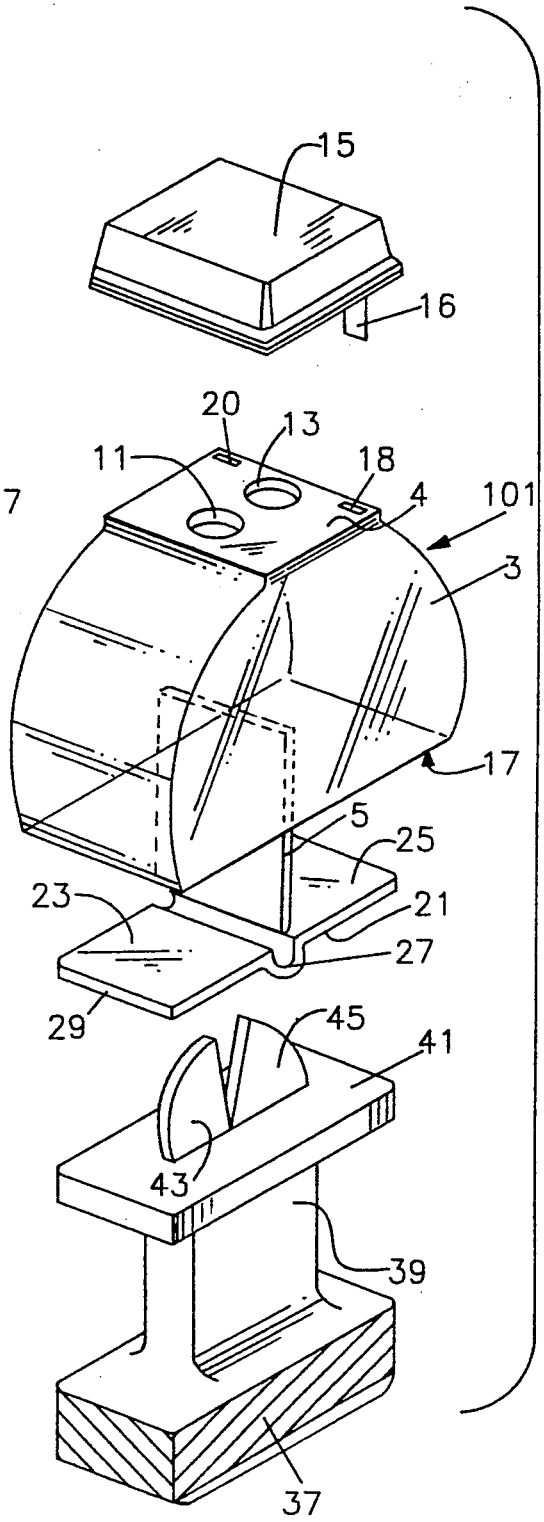
FIG. 2

PUSH UP CODISPENSING CONTAINER

BACKGROUND OF THE INVENTION

1. Field of the Invention

The present invention is directed to codispensing of semi-solid materials and more particularly to a container for codispensing semi-solids which advantageously permits the user to codispense in a predetermined ratio. Thus, the present invention involves a codispensing container utilizing a housing having two or more fins which simultaneously rotate towards one another to force the semi-solid materials out of the container.

2. Prior Art Statement

Dual component dispensing is well known in the art and numerous developments have occurred to enable a user of a container to codispense two components simultaneously.

Thus, U.S. Pat. No. 3,296,803 to Kroekel, issued Jan. 10, 1967 describes a system for codispensing utilizing bellowed compartments which close down under pressure to simultaneously force two components from the dispensing container.

Likewise, U.S. Pat. No. 4,205,766 issued to Douglas White on Jun. 3, 1980 teaches a dual component system for simultaneous dispensing of liquids and in this case a piston forces material out of one cylinder while the bottom of that cylinder acts in a counter direction to force material out of the container which is connected to the rod of the piston.

U.S. Pat. No. 4,432,469 to Eble and Lang and assigned to Hilti Aktiengesellschaft describes a device for discharging plural components simultaneously and involves the movement of a piston simultaneously through a plurality of compartments.

Likewise, U.S. Pat. No. 4,526,295 to Morel and Morel describes another system for simultaneous dispensing of two components. In this system, one compartment moves downward into a second compartment as the first acts as a piston on the second to create the codispensing.

U.S. Pat. No. 4,989,758 describes a double delivery cartridge for two materials which relies upon direct upward movement of materials by feed pistons which are pushed upwardly, but which do not rotate.

U.S. Pat. No. 5,020,694 to Pettengill describes a multi-cavity dispensing container utilizing push up type cylindrical extensions which are connected to one another.

Notwithstanding the prior art which teaches numerous variations on the idea of dual compartments which have relative movement or have pistons or plungers, none of the prior art teaches the system in the present invention involving the use of two or more walls or fins moving rotatably towards each other to simultaneously dispense semi-solid components from a single container and, in its preferred embodiments of the present invention, by movement of a push arm or by rotation of a single dial.

SUMMARY OF THE INVENTION

The present invention is a container for codispensing two or more semi-solid products which is operable by outside manual motion. It includes a main body which is divided into at least two compartments by a divider wall so as to form a plurality of compartments with at least a first compartment and a second compartment. It also has outlet means connected to each of said plurality of compartments. There are one or more fins located within the first compartment, this first fin having an inner edge, and being rotatably connected to the housing at the inner edge, and a second fin located in the second compartment, this second fin having an inner edge, and being rotatably connected to the housing at the inner edge. There is means for simultaneously rotatably moving the plurality of fins so as to decrease the volume within said compartments and so as to push material therein out simultaneously for codispensing. In preferred embodiments, two fins are symmetrical and opposite one another and rotate towards one another to dispense through a common outlet.

BRIEF DESCRIPTION OF THE DRAWINGS

The present invention is more fully understood when the instant specification is taken in conjunction with the drawings which are appended hereto, wherein:

FIG. 1 shows a partial side cut view of a preferred embodiment container of the present invention;

FIG. 2 shows an oblique exploded side view of the present invention device shown in FIG. 1;

DETAILED DESCRIPTION OF THE PRESENT INVENTION

Figure 3:
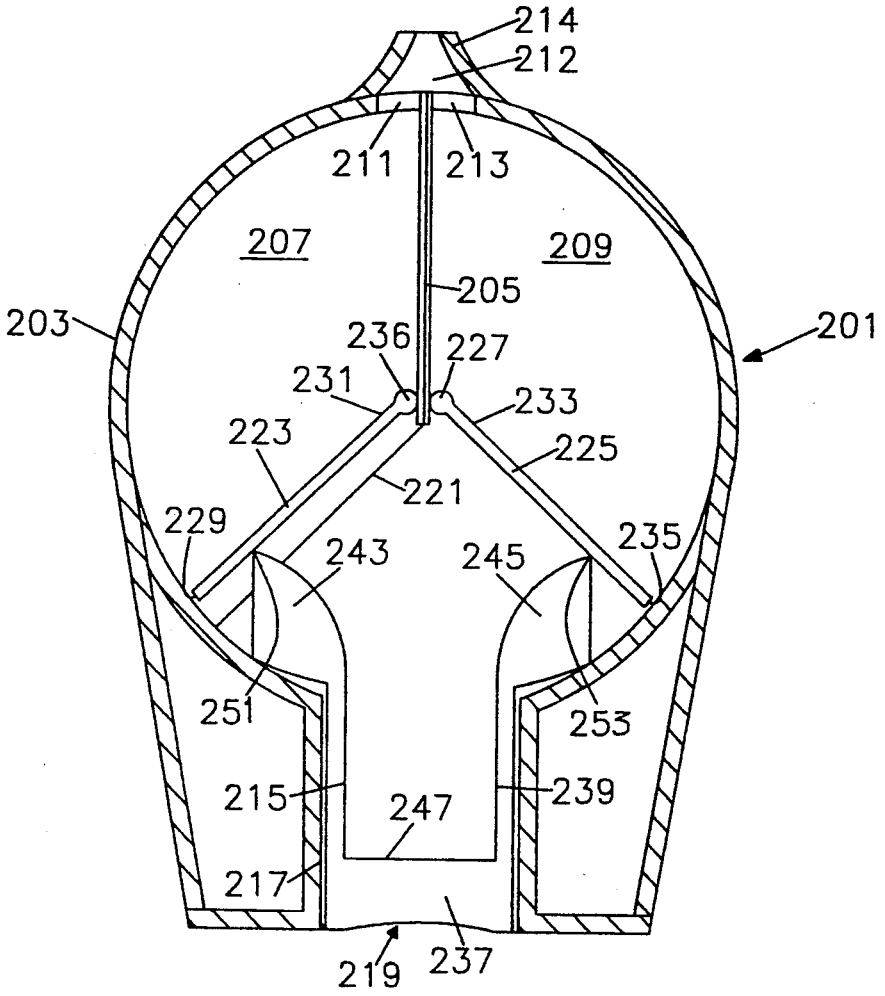
FIG. 3 shows a side cut view of an alternative embodiment present invention codispensing container for codispensing three different materials; and, FIG. 4 shows a cut top view of the device shown in FIG. 3.

The present invention involves a codispensing container for two or more semi-solid materials by a single movement or motion by the user. Thus, it is an objective of the present invention to develop a container which may be operated by the user by a simple rotation so as to codispense two or more materials.

The present invention codispensing container is used to codispense semi-solids, liquids, creams, solutions, dispersions, colloids and the like where two or more materials are kept separately until the time of dispensing. Thus, materials such as dual component toothpastes which would include a peroxide component and a fluoride component may be dispensed with a codispensing container of the present invention. Many other codispensing needs exist in various product marketing and these are well within the artisan's knowledge.

The present invention codispensing container may have virtually any external shape and, generally, must have parallel internal walls, but otherwise may be cylindrical, flat, cylindrical with respect to the horizontal plane, rectangular or otherwise. It may include two fins or more than two fins and thus would include two separate compartments or more than two compartments. The compression effect of rotating fins toward a divider wall or at least toward a common wall may be effected through a push mechanism which is in the bottom or side or even top of a dispenser or may be effected by a rotational dial which may or may not be connected to gearing so as to have various gear ratios. However, in its least complex form, the present invention codispensing container utilizes a push mechanism to effect dispensing.

Referring now to FIG. 1, there is shown codispenser container 101 which includes housing 3 with main center divider wall 5 creating a first compartment 7 and a second compartment 9. First compartment 7 has outlet 11 and second compartment 9 has outlet 13 as shown. A bottom 17 of housing 3 is open to receive pusher 19. The bottom 21 of divider wall 5 is thicker than the rest of the wall to form a shaft. Fins 23 and 25 form the base sections of first compartment 7 and second compartment 9. In this embodiment, fins 23 and 25 are connected in the middle by collar 27 and may be unistructurally formed. Thus, fins 23 and 25 are mounted to housing 3 so as to be rotatable towards one another i.e. they flex about collar 27 and bend towards one another. Fin 23 has outer edge 29 and inner edge 31 and fin 25 has outer edge 33 and inner edge 35. As can be seen, outer edges 29 and 33 are located furthest away from divider wall 5.

Pusher 19 has a base 37, a staff 39, a flange 41 which fits into bottom 17 of housing 3 and has wings 43 and 45 located atop flange 41. Lip 42 at the bottom of housing 3 maintains flange 41 within container 101 after it has been snapped into place. These wings 43 and 45 are like wings on a wing nut and have an opening therebetween which forms a "V". This "V" groove 47 and the apexes 51 and 53 of wings 43 and 45 are moved upwardly during use so that apexes 51 and 53 rotate fins 23 and 25 so that outer edges 29 and 33 move towards one another and fins 23 and 25 push material upwardly and out through outlets 11 and 13 for efficient codispensing.

Groove 47 need not be "V" shaped, but could have any shape, e.g. square, U-shaped, rectangular, etc., as long as it slips over the divider wall 5 adequately to permit wings 43 and 45 to push the fins 23 and 25 rotatably upwardly to and nearly or fully against divider wall 5.

Likewise, wings 43 and 45 could be posts, triangular sections or otherwise as long as they push upwardly, the fins 23 and 25, as indicated above. Nonetheless, the term "wings" used herein should be construed to cover any mechanism which will slide up past a divider wall to move a fin rotatably to push material out of the compartment.

FIG. 2, taken in conjunction with FIG. 1, shows an exploded oblique front view of the present invention device 101, with like parts like numbered, which is shown in FIG. 1. However, in FIG. 2, components are shown as separate pieces and assemblage is clear. Divider wall 5 is shown as being pushed into fins 23 and 25 at divider wall bottom 21 and into collar 27 which is formed by the two fins 23 and 25 as shown. Divider wall 5 is inserted into main housing 3 but could have, alternatively, been formed integrally as part of main housing 3. Additionally, hinges 16 pop into openings 18 and 20 to create a living, plastic hinge for top 15.

Figure 4:
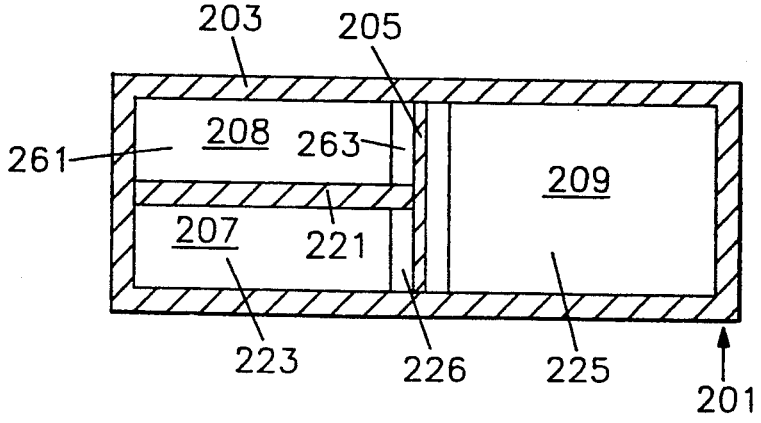

FIG. 3 shows a front cut view of an alternative embodiment of the present invention and FIG. 4 shows a top cut view thereof. Both Figures are to be viewed together. The present invention device 201 includes main housing 203 and divider wall 205. Divider wall 205 has a compartment on its left 207, as well as a compartment on its right 209. However, on the left side, there is a second wall, that is, wall 221 which is at right angles to divider wall 205 which further divides the left hand side into first compartment 207 and third compartment 208. This is shown more clearly in FIG. 4. Thus, when looking at FIG. 3, it should be realized that behind fin 223 is yet a second fin and behind wing 243 is yet a second wing. In fact, FIG. 4 shows fin 261 with hinge 263.

Container 201 does include three fins as shown in FIG. 4 and, FIG. 3 shows fins 223 and 225 with inner edges 231 and 233 and outer edges 229 and 235 respectively. Each has a hinge 226 and 227 upon which they rotate upwardly toward one another so that outer edges 229 and 235 approach common wall 205 when rotated. There is shown an outlet 211 for compartment 207 and an outlet 213 for compartment 209. Behind wall 221 and, therefore, behind outlet 211 is yet another outlet (not shown) for compartment 208 so that three different materials may be contained within container 201 and codispensed accordingly. Neck 214 includes common outlet 212 so that all three materials ultimately exit in a single mixture therethrough. Bottom 217 has an opening which contains actuator 219. Actuator 219 is outwardly movable and includes groove 247, base 237, two staff sections 215 and 239, and wings 243 and 245, respectively having apexes 251 and 253. A third wing identical to and directly behind wing 243 is located therein but not seen due to this particular view. However, that particular wing and wing 243 would be on opposite sides of wall 221 and each would be approximately one-half the thickness of wing 245, although, there is no need for wing 245 to be the full depth or thickness of the housing and, the wings may separately be of all the same width and yet still have the device function so as to codispense three different materials. Basically, there exists a space between wing 243 and the wing behind it as well as staff section 215 and a staff section behind it so that as actuator 219 is pushed upwardly, there is a space between these wings through which wall 221 will pass. Thus, a user pushes up on the bottom of base 237 of actuator 219 and this causes apexes 251, 253 and the one not shown to respectively push up on the fins above them to cause material to be moved through their respective outlets such as outlet 211, to mix in common outlet 212 and dispense from container 201 accordingly. Although not shown, ratchets could be used in conjunction with actuator 219 so as to afford single click ups of equal or graduated amounts so as to push out metered or counted amounts of materials, as may be desired.

As alternatives to the devices or containers shown in FIGS. 1 through 4 above, it should be noted that the container of the present invention could be designed with the actuator being pushed from the side and dispensing occurring out the opposite side, alternatively, a rack and pinion could be used and separate axles having separate gears on the pinion, with one having an intermediate reversal gear could be utilized in an arrangement where a side actuator is pushed to cause dispensing out of the top or bottom of a container. Further, the present invention container may be made exclusively of plastics, may be made of glass, plastics, metals or combinations of these, depending upon the particular choice of the manufacturer and the particular materials which are to be dispensed therewith.

Seals may be used between walls and fins, if desired. The types of seals will depend upon the types of materials involved and the necessity for contamination avoidance, either by the materials with one another or with air or otherwise.

Obviously, numerous modifications and variations or the present invention are possible in light of the above teachings. It is therefore understood that within the scope of the appended claims, the invention may be practiced otherwise than as specifically described herein.

What is claimed is:

1. A container for codispensing two or more semi-solid products which is operable by outside manual motion, comprising:

(a) a main body, said main body being divided into at least two compartments by a divider wall so as to form a plurality of compartments with at least a first compartment and a second compartment;

(b) outlet means connected to each of said plurality of compartments;

(c) a plurality of fins with at least a first fin located within said first compartment, said fin having an inner edge and an outer edge, with said first fin being rotatably connected to said housing at said inner edge, and a second fin located in said second compartment, said second fin having an inner edge and an outer edge, with said second fin being rotatably connected to said housing at said inner edge; and, (d) means for simultaneously rotatably moving said plurality of fins so as to cause the outer edges of the fins to move towards one another, and so as to decrease the volume within said compartments, and so as to push material therein out simultaneously for codispensing.

2. The container of claim 1, wherein a first outlet means and a second outlet means are located adjacent one another near said divider wall.

3. The container of claim 1, wherein said means for simultaneously rotatably moving said plurality of fins towards one another comprises a push up actuator having a plurality of wings which push up and rotate said fins within said main body.

4. The container of claim 3, wherein said fins are connected to one another via a common base and wherein a groove is formed between said fins.

5. The container of claim 4, wherein said outlet means are located adjacent one another near said divider wall.

6. The container of claim 5, wherein said fins are symmetrical and opposite one another.

7. The container of claim 1, wherein said plurality of outlet means join to form a single, common outlet means.

8. The container of claim 1, wherein at least three compartments, at least three fins and at least three wings are included.

9. The container of claim 8, wherein at least two of said compartments, fins and wings are located adjacent one another.

* * * * *